United States Patent [19]

Igel

[11] Patent Number: 4,586,326

[45] Date of Patent: May 6, 1986

[54] SPINNING MACHINE WITH ROVING-BOBBIN FEEDER

[75] Inventor: Wolfgang Igel, Ebersbach, Fed. Rep. of Germany

[73] Assignee: Zinser Textilmaschinen GmbH, Ebersbach, Fed. Rep. of Germany

[21] Appl. No.: 549,690

[22] Filed: Nov. 7, 1983

[30] Foreign Application Priority Data

Nov. 5, 1982 [DE] Fed. Rep. of Germany ..... 3240822

[51] Int. Cl.[4] ..... D01H 9/18; D01H 9/02

[52] U.S. Cl. ..... 57/281; 57/90; 57/266; 57/268; 57/270; 57/276; 414/392

[58] Field of Search ..... 57/90, 270, 266–268, 57/276, 277, 281, 278, 275; 198/409, 477, 651; 414/416, 392

[56] References Cited

U.S. PATENT DOCUMENTS

| | | | |
|---|---|---|---|
| 1,384,449 | 7/1921 | Graf | 57/266 |
| 1,463,479 | 7/1923 | Miller | 57/266 |
| 2,952,113 | 9/1960 | Ingham | 57/268 |
| 3,264,027 | 8/1966 | Luther | 57/275 X |
| 3,307,340 | 3/1967 | Nishii et al. | 57/270 X |
| 3,370,411 | 2/1968 | Schultz et al. | 57/274 |
| 3,773,191 | 11/1973 | Ishida | 57/276 |
| 3,854,275 | 12/1974 | Bethea et al. | 57/276 X |
| 3,935,699 | 2/1976 | Iida | 57/270 X |
| 4,041,686 | 8/1977 | Inaba et al. | 57/281 |

FOREIGN PATENT DOCUMENTS

| | | |
|---|---|---|
| 2225673 | 11/1972 | Fed. Rep. of Germany . |
| 1760457 | 8/1973 | Fed. Rep. of Germany . |
| 1813110 | 7/1975 | Fed. Rep. of Germany . |
| 2021498 | 3/1976 | Fed. Rep. of Germany . |
| 550734 | 5/1974 | Switzerland . |
| 1624 | of 1902 | United Kingdom . |
| 712423 | 7/1954 | United Kingdom . |
| 854968 | 11/1960 | United Kingdom . |
| 1044477 | 9/1966 | United Kingdom . |
| 1190510 | 5/1970 | United Kingdom . |
| 1437294 | 5/1976 | United Kingdom . |

*Primary Examiner*—John Petrakes

*Attorney, Agent, or Firm*—Karl F. Ross; Herbert Dubno

[57] ABSTRACT

A stationary service unit at one end of an elongate spinning machine coacts with a supply carriage delivering bobbins wound with rovings from a flyer at a preparatory stage and loads these bobbins onto depending grippers which are movable, manually or automatically, on an overhead guide rack. The rack may form an endless loop about the machine bed or may be divided into two parallel sections flanking same; in the latter instance the service unit may be swingable about a vertical axis toward one or the other section.

11 Claims, 3 Drawing Figures

SPINNING MACHINE WITH ROVING-BOBBIN FEEDER

FIELD OF THE INVENTION

My present invention relates to a spinning machine of the type wherein rovings are wound on bobbins in a preparatory or pre-spinning stage including one or more flyers, these bobbins being subsequently mounted on a guide rack for feeding the rovings to spindles at respective working positions of the spinning machine proper.

BACKGROUND OF THE INVENTION

In a plant of the type here considered, it is customary to place the roving-laden bobbins at the preparatory stage on a carriage for transportation to an associated spinning machine. There, an operator will lift an oncoming bobbin out of the carriage and either position it directly on the guide rack, as a replacement for an exhausted active bobbin, or store it temporarily in an adjacent area. While the circulation of a bobbin-transporting carriage between a roving frame or flyer of the preparatory stage and a given spinning machine can be automatically controlled, the removal of the arriving replacement bobbins from the carriage and their assignment to a working position in need thereof—with or without interim storage—is still a labor-intensive operation and correspondingly uneconomical. Such roving bobbins can be quite heavy, in fact, weighing sometimes as much as 3.5 kg.

In commonly owned application Ser. No. 476,546, filed by me jointly with two others on Mar. 18, 1983, there has been disclosed a spinning machine associated with a carriage having retaining means for receiving the replacement bobbins to be transported; this carriage is arrested at a holding station near the path of a service unit of the type referred to above. The service unit has transfer means programmed to pick up one or more replacement bobbins at a time for the retaining means of the carriage for delivery to a storage area in the vicinity of the guide rack of the spinning machine. This mobile service unit—whose main function is that of tying broken yarns or blowing air, for example—carries out the previously manually performed tasks of taking replacement bobbins from a transporter and placing them in a storage area near the supply rack which is usually at an elevated location. The human operator is consequently relieved of the duty to lift these roving-laden bobbins and may only have to shift them from the storage area to a mandrel or other gripper on the rack after removing a spent active bobbin therefrom. The latter task may be performed manually even though, in principle, it could also be automated, e.g. with the aid of a donning and doffing mechanism similar to that described in commonly owned U.S. Pat. No. 3,370,441.

There are, however, spinning machines not equipped with such a mobile service unit for which a special transporter would have to be provided in order to carry out the transfer of replacement bobbins from the supply carriage to the vicinity of a working position.

OBJECT OF THE INVENTION

The object of my present invention, therefore, is to provide alternative means for at least semiautomatically handling such a transfer.

SUMMARY OF THE INVENTION

This object is realized, in accordance with my present invention, by the provision of a stationary service unit disposed adjacent an elongate bed of a spinning machine which is equipped with an overhead guide rack extending alongside that bed and with grippers movable along that rack to any of a plurality of storage areas in the vicinity of the working position to be served, each gripper being designed to engage a bobbin delivered thereto for releasably holding same with the aid of suitable detent means as is well known in the art. A supply carriage shuttling between the preparatory stage and a position adjoining the service unit is provided with retaining means for the transportation of roving-laden replacement bobbins, the retaining means preferably comprising a plurality of horizontal pegs loadable at the preparatory stage with respective bobbins as described in the copending application Ser. No. 476,546 whose disclosure is incorporated by reference into my present application. The service unit, which may also be generally similar to that disclosed in the copending application aside from having a stationary frame, is provided with transfer means programmed to pick up one or more replacement bobbins at a time from the retaining means of the supply carriage and to deliver same to respective grippers depending from the overhead rack.

The bobbin-engaging grippers may be displaceable along the rack by hand or automatically, advantageously with the aid of an endless chain when the rack forms a closed loop around the machine bed. In such a case the grippers will successively pass by the service unit and can be loaded from that unit as required, e.g. upon detection of an absent replacement bobbin on such a gripper by sensing means of the type described in the copending application. It is, however, also possible to divide the rack into two parallel sections bracketing the bed; in that instance the service unit can be located at an end of the bed between two rack sections and its transfer means can be selectively swingable on that unit about a vertical axis into alignment with the grippers of one or the other section.

In either case, the transfer means of the service unit preferably comprises a support movable horizontally and vertically on the stationary upright frame of the service unit. This support is to be provided with grasping means which could be a bobbin-extracting mechanism similar to that of the copending application, or of some simpler construction, and which advantageously can be swung about a horizontal axis between a horizontal and a vertical position for engagement with a replacement bobbin on a confronting peg in its horizontal position and for coaction with an aligned overhead gripper in its vertical position.

BRIEF DESCRIPTION OF THE DRAWING

The above and other features of my present invention will now be described in detail with reference to the accompanying drawing in which.

SPECIFIC DESCRIPTION

Figure 1:
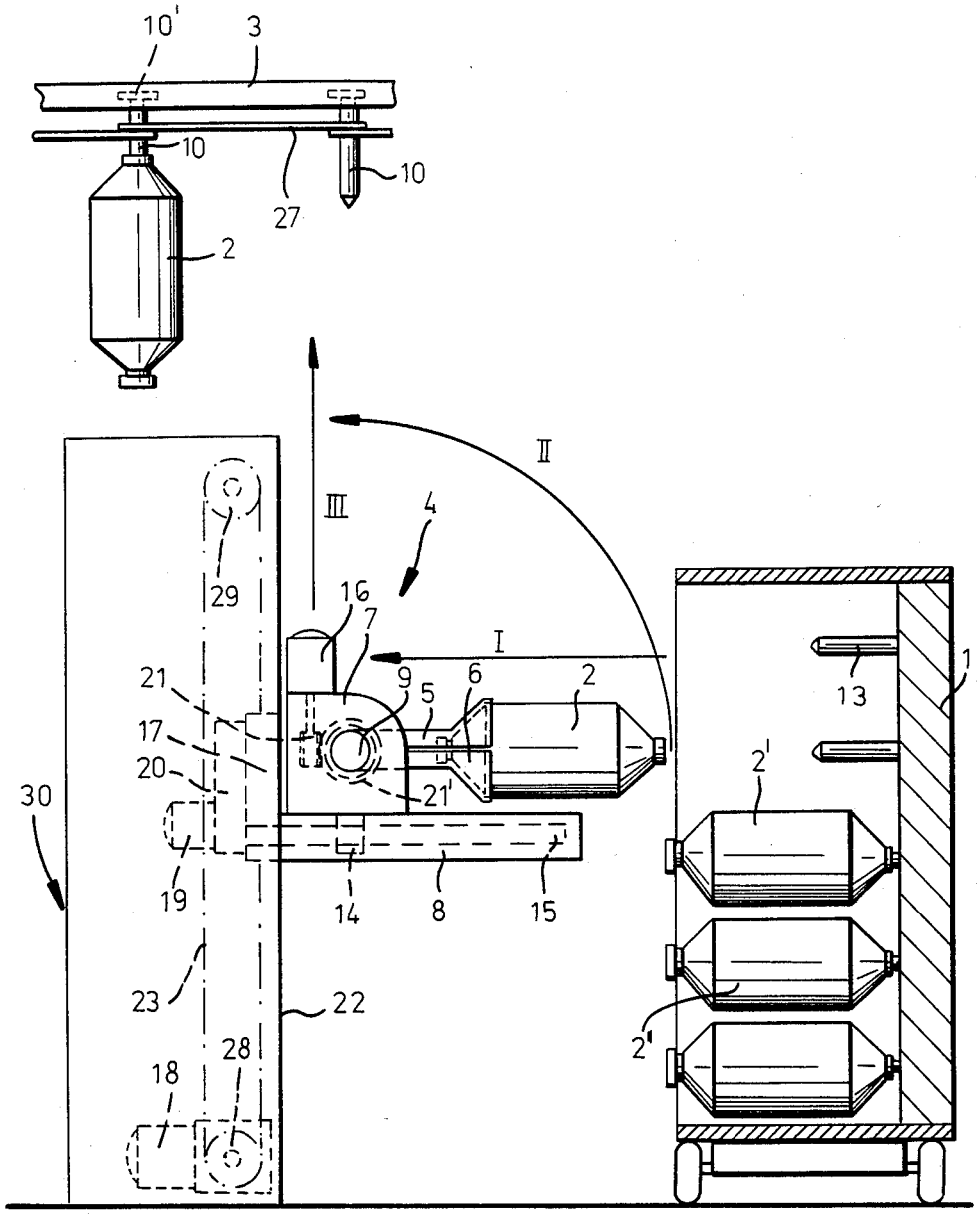
FIG. 1 is an elevational view of a supply carriage, a service unit and an overhead guide rack in an assembly embodying my invention.
Figure 2:
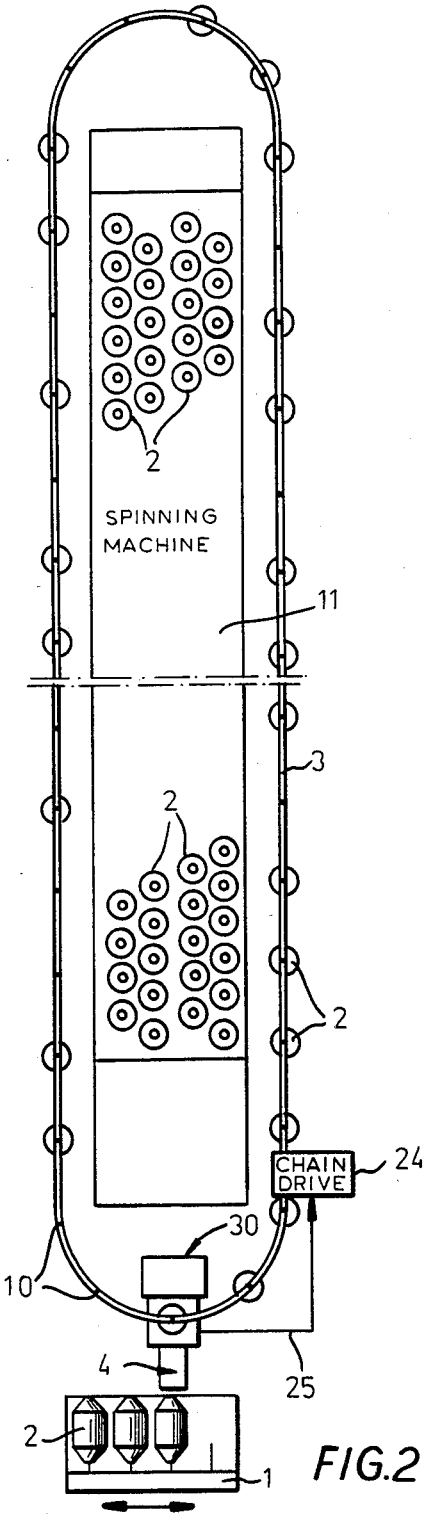
FIG. 2 is a somewhate diagrammatic top view of a spinning machine equipped with the assembly of FIG. 1.

As shown in FIG. 1, a service unit 30 according to my invention comprises a stationary frame 22 provided with transfer means 4 designed to pick up roving-laden bobbins 2, 2', 2'' from a supply carriage 1 receiving these bobbins from a remote preparatory stage. A transfer means for the transfer of bobbins between horizontal and vertical positions is shown in FIG. 15 of U.S. Pat. No. 3,307,340. An overhead rack 3 (see FIG. 10 of U.K. patent specification No. 1,044,477) is provided with a multiplicity of depending grippers 10 which have been shown schematically as simple pins but, of course, will have to be fitted with suitable detent means (e.g. elements 47 of U.K. patent specification No. 1,044,477) for releasably retaining a bobbin 2 in a position into which it is brought by the transfer mechanism. In this embodiment the rack 3 is assumed to form a closed loop, as illustrated in FIG. 2, about an elongate bed 11 of a spinning machine provided with a multiplicity of working positions which have been schematically indicated by a number of bobbins 2 viewed from above. Rack 3 is equipped with an endless chain 27 whose links are interconnected by hinge joints formed in part by the pins 10. The rack is designed as a rail with a downwardly open T-profile channel in which the pins 10 are slidably held by enlarged heads 10'. A drive unit 24, schematically indicated in FIG. 2, coacts with the chain 27 (e.g. by means of a friction roller laterally adjoining its links) to advance all the grippers and their bobbins unidirectionally along the rack 3 so that an operator at a working position requiring a new bobbin can pick one off the rack as it passes by.

The transfer mechanism 4 comprises a pair of grasping jaws 5, 6 (see FIG. 8 of U.K. patent specification No. 1,044,477; U.S. Pat. No. 1,384,449; FIG. 4 of U.S. Pat. No. 3,935,699; and U.S. Pat. No. 3,264,027) which are separable to reach around the confronting end of a bobbin 2 aligned therewith on carriage 1. This carriage is provided with a number of horizontal pegs 13 which may be arrayed in several vertical columns as will be apparent from FIGS. 1 and 2; in the present instance there are four such columns of five pegs each. Grasping jaws 5, 6 are mounted on a slider 7 which is horizontally movable on a shelf 8 (see movement of member 26 in U.S. Pat. No. 3,935,699) with the aid of a nut 14 engaged by a leadscrew 15, the shelf 8 being supported via a mounting 17 on a vertical run of a transmission chain 23 which is led about sprockets 28 and 29 on frame 22. (Note that a gripper moving on a chain conveyor is described in U.K. patent specification No. 1,624 of 1902.) Sprocket 28 is driven by a motor 18 whereas another motor 19 operates the leadscrew 15 by way of a speed reducer 20. With the aid of motor 18, therefore, jaws 5, 6 can be aligned with a horizontal row of pegs 13 of carriage 1; this carriage, in turn, is positionable so that any one of its four vertical columns of pegs is aligned with jaws 5, 6 for the transfer of a selected bobbin from the carriage to the service unit. A further motor 16 drives a worm 21 which engages a worm gear 21' on a horizontal shaft 9 journaled in slider 7; motor 16 is reversibly operable to rotate the shaft 9 together with jaws 5, 6 between the illustrated horizontal position of the jaws and a vertical position in which their axis is alignable with a gripper pin 10 on the overhanging rack 3.

In FIG. 2 there is indicated an electrical connection 25 extending from transfer mechanism 4 to driving unit 24. This enables a human operator, or an automatic sensor of the type described in copending application Ser. No. 476,546, to arrest the chain 27 upon detection of an empty pin 10 in a position in which that pin lies directly above the junction of shaft 9 with jaws 5, 6. With motor 18 operated to align these jaws with a peg 13 of carriage 1 supporting a fresh bobbin 2, and jaws 5, 6 in their horizontal position, slider 7 is advanced by motor 19 toward carriage 1 until the jaws grasp the confronting bobbin 2 whereupon the rotation of motor 19 is reversed to return the slider to its normal position as indicated by an arrow I. Next, motor 16 is actuated to swing the jaws 5, 6 with the engaged bobbin 2 into a vertical position as indicated by an arrow II. Thereafter, motor 18 is energized to raise the shelf 8 to its uppermost position, as indicated by an arrow III, in which the core tube of bobbin 2 is penetrated by the aligned gripping pin 10 whereupon the jaws 5, 6 are separated by a nonillustrated spreader to release the bobbin transferred to rack 3. Motors 16, 18 and 19 as well as the associated spreader are controllable in the proper time sequence by a programmer activated by the human operator or by the sensor referred to. The spreader may include a fluidic jack similar to one forming part of a more elaborate grasping device disclosed in the copending application identified above.

After the transfer has been completed, motor 18 is reversed to lower the shelf 8 whereupon a reversal of motor 16 restores the horizontal position of the grasping jaws. If desired, the aforedescribed operation of these jaws for pulling a fresh bobbin off the carriage 1 can be repeated at this time—e.g. with the next-lower bobbin 2'—in preparation of another transfer.

Figure 3:
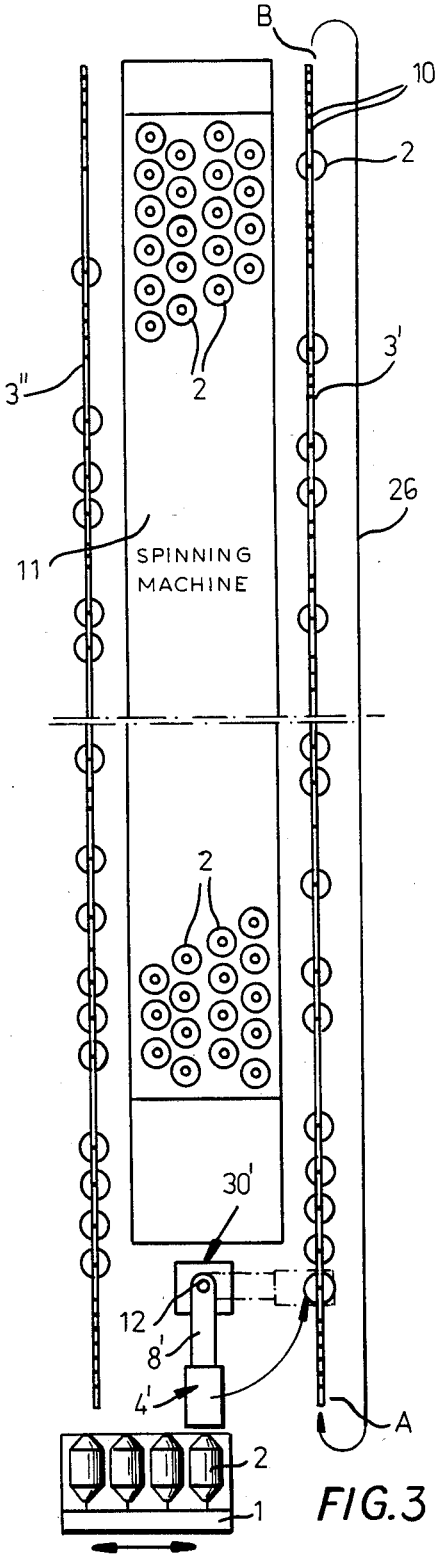
FIG. 3 is a view similar to that of FIG. 2, illustrating a modification.

In FIG. 3 I have illustrated a modified assembly with an overhead rack divided into two parallel sections 3' and 3'' flanking the machine bed 11. With a service unit 30' positioned—like unit 30 in FIG. 2—at one end of the bed, the shelf 8' of its transfer mechanism 4' is swingable about a vertical axis 12 through 180° between a bobbin-engaging position shown in full lines, a first bobbin-releasing position illustrated in phantom lines and a second bobbin-releasing position directly opposite the latter. The gripping pins 10 guided by rack sections 3' and 3'' are here assumed to be manually slidable in their channels from one end A to an opposite end B thereof as particularly illustrated for section 3'. An operator, noting the arrival of the fully loaded carriage 1 adjacent the service unit 30', can now control the transfer of some of the newly arrived bobbins to vacant pins of either rack section 3', 3'' by a sequence of operations differing from that described above by the interposition of a horizontal swing of shelf 8' into and back from one or the other bobbin-releasing position. This swing may be performed manually or automatically by means of another programmer-controlled motor coupled with shaft 12 which links the shelf 8' with an underlying horizontal extension of the mounting 17 shown in FIG. 1.

The rack sections 3' and 3'' may be further provided, as particularly illustrated for section 3', with respective return tracks 26 forming closed loops by which grippers 10 relieved of their bobbins can be recycled from the far end B to the proximal end A for reloading. It will also be understood that each of the loops so formed could be equipped with an automatic transporter such as the endless chain 27 for jointly displacing the associated grippers past the corresponding side of machine bed 11. It will further be apparent that the driving unit 24 associated with such an endless chain, instead of continuously advancing that chain at slow speed unless interrupted via connection 25, may be normally at standstill and set in motion by an operator only when the need for a reloading of some of its grippers arises.

I claim:

1. In a spinning machine, the combination of:

an elongate bed provided with a multiplicity of working positions wherein rovings are produced in a preparatory stage;

an overhead guide rack extending alongside said bed;

grippers depending from said rack;

active bobbins mounted on said grippers, said rovings being drawn from said bobbins;

a stationary service unit disposed adjacent said bed;

a carriage provided with retaining means for transporting roving-laden replacement bobbins from said preparatory stage to a position adjoining said service unit; and transfer means on said service unit programmed to pick up at least one replacement bobbin at a time from said retaining means and to deliver same to one of said grippers, each of said grippers being movable along said guide rack to any of a plurality of storage areas in the vicinity of said working positions.

2. The combination defined in claim 1, further comprising driving means on said guide rack coupled with all said grippers for jointly displacing same past said bed.

3. The combination defined in claim 2 wherein said guide rack forms an endless loop around said bed.

4. The combination defined in claim 3 wherein said driving means comprises an endless chain with links interconnected by pins forming part of said grippers.

5. The combination defined in claim 1 wherein said guide rack is divided into two parallel sections bracketing said bed, said service unit being disposed at an end of said bed between said sections, said transfer means being selectively swingable on said service unit about a vertical axis into alignment with grippers on either of said sections.

6. The combination defined in claim 5 wherein said sections are provided with respective return tracks for the recirculation of said grippers past said service unit.

7. The combination defined in claim 1 wherein said service unit is provided with an upright frame, said transfer means comprising a support movable horizontally and vertically on said frame.

8. The combination defined in claim 7 wherein said retaining means comprises a plurality of horizontal pegs loadable at said preparatory stage with respective replacement bobbins, said support being provided with grasping means swingable about a horizontal axis between a horizontal and a vertical position for engagement with a replacement bobbin on a confronting peg in said horizontal position and for coaction with an aligned gripper in said vertical position.

9. The combination defined in claim 8 wherein said support comprises a vertical conveyor, a shelf elevatable and lowerable on said conveyor, and a slider horizontally movable on said shelf.

10. The combination defined in claim 9 wherein said shelf is horizontally pivotable about a vertical axis between two diametrically opposite positions.

11. The combination defined in claim 8 wherein said pegs are arrayed on said carriage in a plurality of vertical columns.

* * * * *